US008790109B1

(12) United States Patent
Brownson

(10) Patent No.: US 8,790,109 B1
(45) Date of Patent: Jul. 29, 2014

(54) PRE-CAST CONCRETE WALL SYSTEM

(76) Inventor: Thad J. Brownson, Villa Rica, GA (US)

( * ) Notice: Subject to any disclaimer, the term of this patent is extended or adjusted under 35 U.S.C. 154(b) by 279 days.

(21) Appl. No.: 13/080,401

(22) Filed: Apr. 5, 2011

Related U.S. Application Data

(60) Provisional application No. 61/320,790, filed on Apr. 5, 2010.

(51) Int. Cl.
*B28B 7/16* (2006.01)
*B28B 7/04* (2006.01)

(52) U.S. Cl.
USPC ..... 425/435; 425/442; 425/451.9; 425/452; 249/64; 249/120; 249/122; 249/124; 249/137; 249/139; 249/142; 249/163; 249/170; 249/177; 249/189

(58) Field of Classification Search
CPC ..... B28B 7/04; B28B 7/08; B28B 7/16
USPC ..... 249/18–25, 33–35, 39, 44, 64, 122, 249/124, 120, 137, 139, 142, 163, 165–172, 249/189, 177; 264/333; 425/435, 441, 442, 425/443, 444, 451.9, 452
See application file for complete search history.

(56) References Cited

U.S. PATENT DOCUMENTS 1,325,051 A * 12/1919 Stahl et al. ..... 249/99
1,326,246 A * 12/1919 Young ..... 249/108
1,968,189 A * 7/1934 Bartels ..... 249/18
2,892,339 A * 6/1959 Flower et al. ..... 52/608
3,490,186 A 1/1970 Hammond
3,659,986 A * 5/1972 Gelbman ..... 425/88
3,752,437 A * 8/1973 Saidla ..... 249/172
3,885,008 A * 5/1975 Martin ..... 264/45.3
3,898,776 A 8/1975 Cox et al.
3,948,311 A * 4/1976 Sylvester ..... 164/341
3,979,863 A 9/1976 Hurley et al.
4,027,846 A * 6/1977 Caplat ..... 249/189
4,077,757 A * 3/1978 DeCoster ..... 425/218
4,149,697 A * 4/1979 Linetsky ..... 249/120
4,228,985 A * 10/1980 Gaudelli et al. ..... 249/93
4,259,824 A 4/1981 Lopez
4,328,651 A 5/1982 Gutierrez
4,372,092 A 2/1983 Lopez (Continued)

FOREIGN PATENT DOCUMENTS

DE 3520581 A1 * 12/1985 ..... B29C 33/24
GB 2224233 A * 5/1990 ..... B29C 33/48
JP 03173608 A * 7/1991 ..... B28B 21/30

*Primary Examiner* — Dimple Bodawala
(74) *Attorney, Agent, or Firm* — Robert C. Montgomery; Montgomery Patent & Design

(57) ABSTRACT

A pre-cast concrete wall system for crawlspace applications is herein disclosed. The system includes a plurality of interconnected pre-cast concrete wall panels having a recessed area along one side to reduce concrete usage and weight, while maintaining load bearing properties. The wall panels are securely fastened to a substructure, such as footers, using anchors and to each other by opposingly aligned keyways and connecting fasteners. Each wall panel includes at least one (1) pair of leveling bolts which provides for the leveling of the wall panels and correct for any unevenness in the footer. The wall panels are fabricated using a rotating casting table which allows an operator to pour concrete at ergonomic heights and rotate the casting table and cured wall panel member to a vertical position for convenient unloading and transportation of the wall panel to a job site.

19 Claims, 8 Drawing Sheets

(56) References Cited

U.S. PATENT DOCUMENTS

| | | | | |
|---|---|---|---|---|
| 4,477,204 | A | 10/1984 | Rohde et al. | |
| 4,540,540 | A * | 9/1985 | Jackson et al. | 264/272.11 |
| 4,606,878 | A | 8/1986 | Day et al. | |
| 4,659,057 | A * | 4/1987 | Felter | 249/97 |
| 4,660,344 | A * | 4/1987 | Gaudelli et al. | 52/592.1 |
| 4,690,632 | A * | 9/1987 | Carrow | 425/429 |
| 4,735,562 | A * | 4/1988 | Boutellier | 425/62 |
| 5,393,033 | A * | 2/1995 | Wilson | 249/155 |
| 6,128,878 | A * | 10/2000 | Erickson | 52/319 |
| 6,491,473 | B2 | 12/2002 | Veazey | |
| 6,659,686 | B2 | 12/2003 | Veazey | |
| 6,848,232 | B2 * | 2/2005 | Pulte et al. | 52/781.5 |
| 7,617,640 | B2 * | 11/2009 | Bradley | 52/127.2 |
| 2007/0023959 | A1 * | 2/2007 | Wilkinson et al. | 264/265 |
| 2007/0276526 | A1 * | 11/2007 | Swanson | 700/95 |

* cited by examiner

PRE-CAST CONCRETE WALL SYSTEM

RELATED APPLICATIONS

The present invention was first described in and claims the benefit of U.S. Provisional Application No. 61/320,790 filed Apr. 5, 2010, the entire disclosures of which is incorporated herein by reference.

FIELD OF THE INVENTION

The present invention relates generally to building structure construction, and in particular, to a pre-cast concrete wall system and method of fabrication and use thereof.

BACKGROUND OF THE INVENTION

The use of concrete as a building material for foundations has been long established. It is almost indestructible and will last a lifetime in even the harshest of environmental conditions. It is often seen being used on crawlspace walls. Such application requires the building of complicated form work to hold the concrete while it hardens. Such applications also require the use of reinforcing rebar for strength as well. As one could easily imagine, the preparation to pour such walls takes a great deal of time and effort resulting in many days on a construction schedule. Many contractors turn to the use of cinderblock walls to help reduce this time. However, cinderblock walls are well-known to fail and leak over time. Accordingly, there exists a need for a concrete system by which the strength and durability features of solid concrete walls can be provided in crawlspace applications without the costly or time consuming preparation process.

Various proposed methods of using pre-cast concrete wall sections for construction purposes have been attempted. However, none of these methods have been successful at overcoming the inherent disadvantages and deficiencies associated with concrete structures.

SUMMARY OF THE INVENTION

The inventor has therefore recognized the aforementioned inherent problems and lack in the art and observed that there is a need for a device in which pre-cast concrete wall panels are easily fabricated and transportable for use in construction of a foundation structure. In accordance with the invention, it is an object of the present disclosure to solve these problems.

The inventor recognized these problems and has addressed this need by developing a pre-cast concrete wall system that provides the strength and durability features of solid concrete walls as typically provided in crawlspace applications having a reduced weight and materials cost as well as a method of fabrication and use thereof which improves the costly or time consuming preparation and building process. The inventor has thus realized the advantages and benefits of providing a method of constructing a modular pre-cast foundation structure. The construction method includes providing a plurality of pre-cast concrete wall panel members. Each wall panel member includes a perimeter wall frame, a side having a recess area, an opposing flat side, a joining keyway longitudinally disposed along opposing end sides, a plurality of fastener apertures disposed through said opposing end sides of said wall frame within said joining keyway, a plurality of fastener apertures disposed through top and bottom ends of said wall frame, and an anchoring recess disposed in lower end of said wall frame having an anchoring aperture disposed completely through said wall frame bottom end.

Each of the wall panel members is easy fabricated using a casting table. The casting table having a generally rectangular base frame rotatably attached between a pair of rotating assemblies and a flat main plate affixed to a top surface of the base frame. A pair of opposing first mold panels is hingedly attached to opposing upper side edges of the base frame. A pair of opposing second mold panels is hingedly attached to opposing upper front and rear edges of the base frame. At least one (1) recess mold is affixed to a top surface of the main plate. However, various numbers of recess molds can be positioned and affixed to the base plate to provide for wall panel members having different over lengths. The first mold panels and the second mold panels are upwardly pivotable and securable to define an open top form mold to receive an amount of concrete for casting each wall panel member.

The plurality of precast wall panel members each includes a series of integral pre-formed features which provide for structural rigidity suitable to support a load bearing member. Additionally, the wall panel members use a reduced amount of concrete and are less in overall weight that traditional pre-cast concrete structures or on-site formed walls. The wall panel members are easily positioned, leveled, and affixed to one another and to the substructural footer of the construction project.

Furthermore, the described features and advantages of the disclosure may be combined in various manners and embodiments as one skilled in the relevant art will recognize. The disclosure can be practiced without one (1) or more of the features and advantages described in a particular embodiment.

Further objects and advantages of the present invention will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

| DESCRIPTIVE KEY | |
|---|---|
| 10 | pre-cast concrete wall system |
| 20 | wall panel member |
| 22 | recessed area |
| 24 | wall frame |
| 26 | connecting fastener |
| 27 | leveling bolt |
| 28 | anchoring recess |
| 29 | anchor |
| 30 | joining keyway |
| 31 | anchoring aperture |
| 32 | reinforcing bar |
| 33 | grout |
| 34 | fastener aperture |
| 40 | corner member |
| 50 | T-shaped member |
| 51 | fastener access pocket |
| 70 | footer |
| 100 | casting table |
| 105 | rotating motion |
| 110 | base frame |
| 115 | main plate |
| 120 | first mold panel |
| 121 | aperture rods |
| 122 | hinge |
| 123 | keyway mold |
| 124 | second mold panel |
| 125 | rod apertures |
| 127 | anchoring recess mold |
| 130 | support leg |
| 150 | rotating assembly |
| 152 | bearing |
| 153 | pedestal |
| 154 | main shaft |
| 156 | offset block |
| 158 | offset shaft |
| 160 | stand |
| 162 | stand base |
| 170 | recess mold |
| 172 | recess mold flange |
| 175 | clamping fixture |
| 180 | mechanical rotating assembly |
| 181 | actuator |
| 182 | elongated offset block |
| 183 | clevis |
| 200 | concrete |

DETAILED DESCRIPTION OF THE PREFERRED EMBODIMENT

Figure 5:
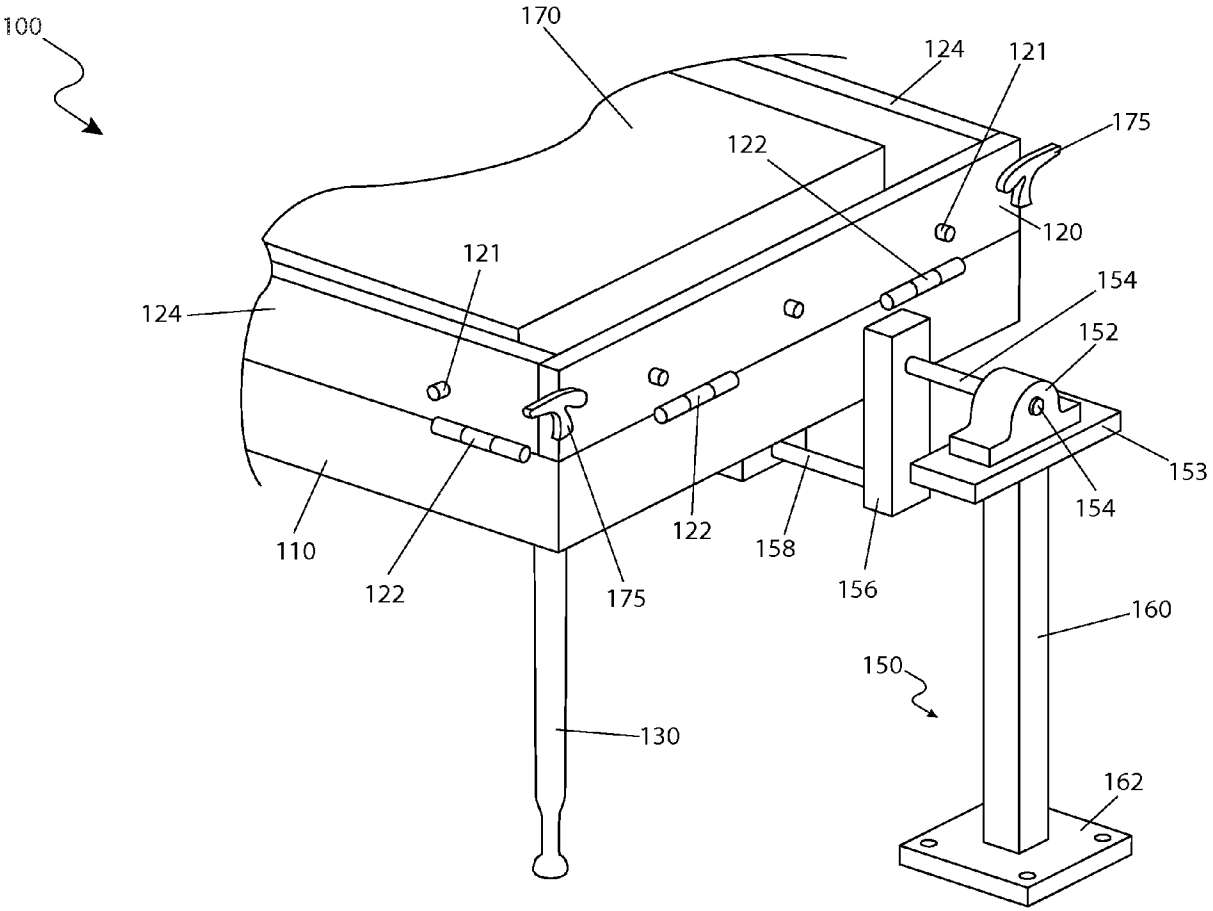
FIG. 5 is a close-up side perspective view of a rotating assembly of the casting table, according to the preferred embodiment.
Figure 6:
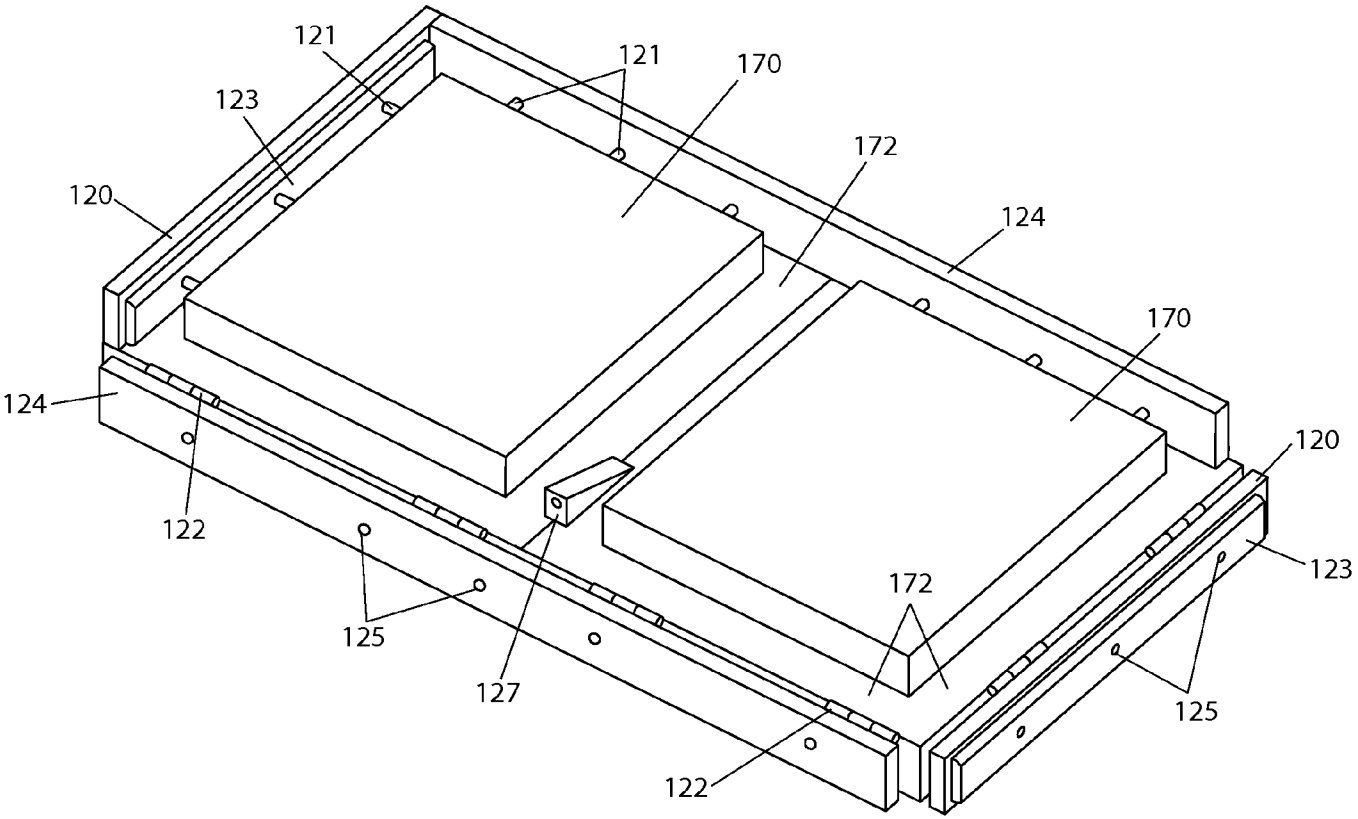
FIG. 6 is partial perspective top view of the casting table, according to the preferred embodiment.
Figure 7:
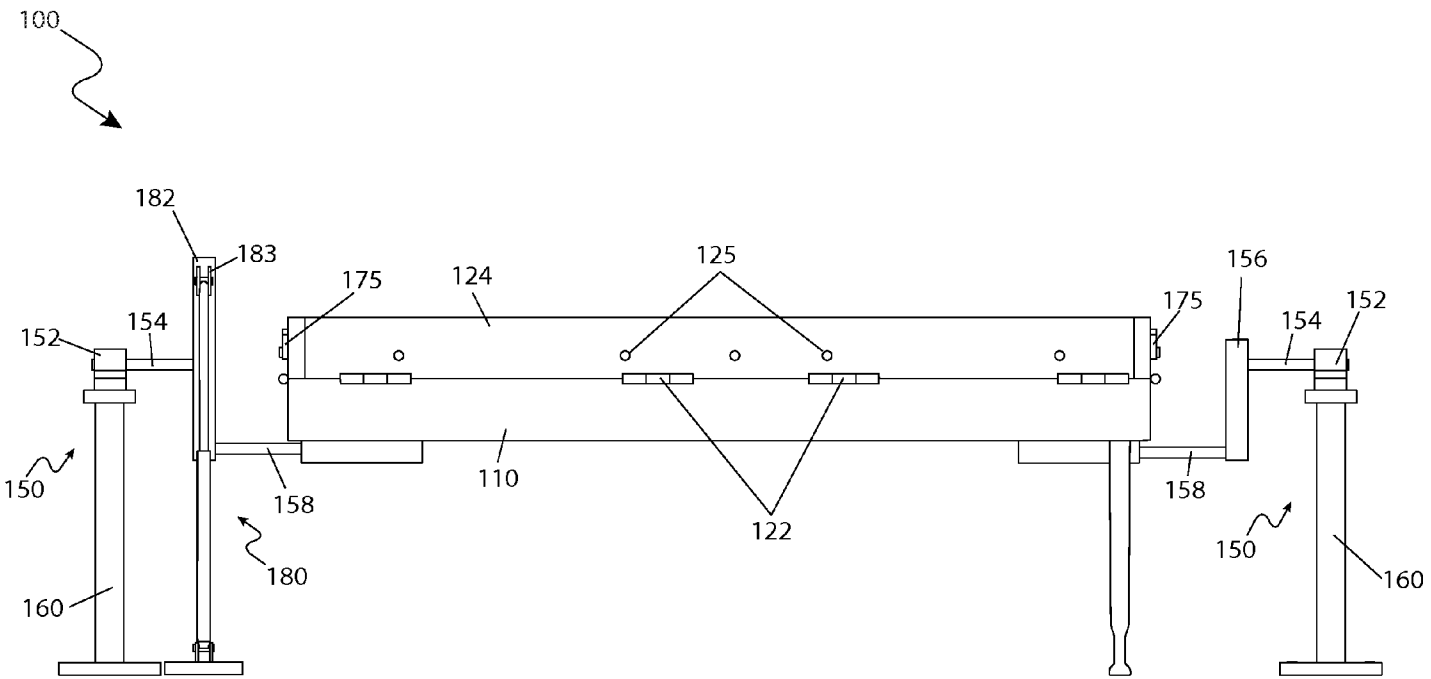
FIG. 7 is a front view of the casting table having an elongated offset block, according to an alternate embodiment in accordance with the invention.
Figure 8B:
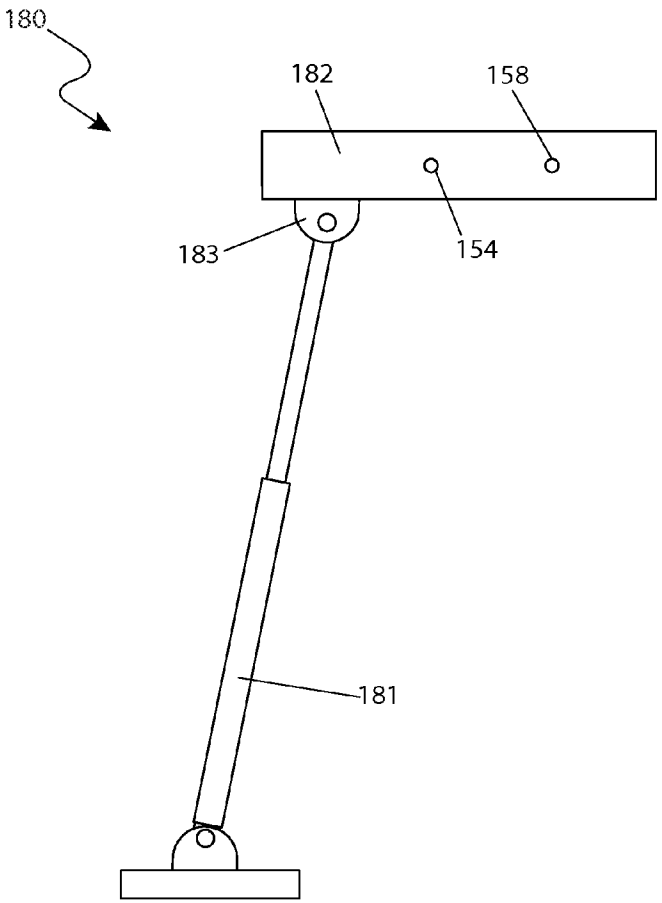
FIG. 8*a* is a partial side view of the elongated offset block as attached to a mechanical actuator depicting the casting table in a generally horizontal position; and, FIG. 8*b* is a partial side view of the elongated offset block as attached to the mechanical actuator depicting the casting table in a generally vertical position.

In accordance with the invention, the best mode is presented in terms of a preferred embodiment, herein depicted within FIGS. 1 through 6 and in terms of an alternate embodiment, herein depicted within FIGS. 7 through 8*b*. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 8*b*, depicting a pre-cast concrete wall system and method of fabrication and use thereof (herein described as a "system") 10, where like reference numerals represent similar or like parts. In accordance with the invention, the present disclosure describes the use of specialized pre-cast foundation members for a building structure, particularly for crawlspace applications. The system 10 generally includes a plurality of interconnected pre-cast wall panels 20, each preferably being approximately six (6) inches thick having a flat exterior face and an interior face having at least one generally rectangular recessed area 22 which maintains structural rigidity but reduces building materials and wall panel weight. The system 10 also includes a casting table 100 for fabricating the devices 20.

Figure 1:
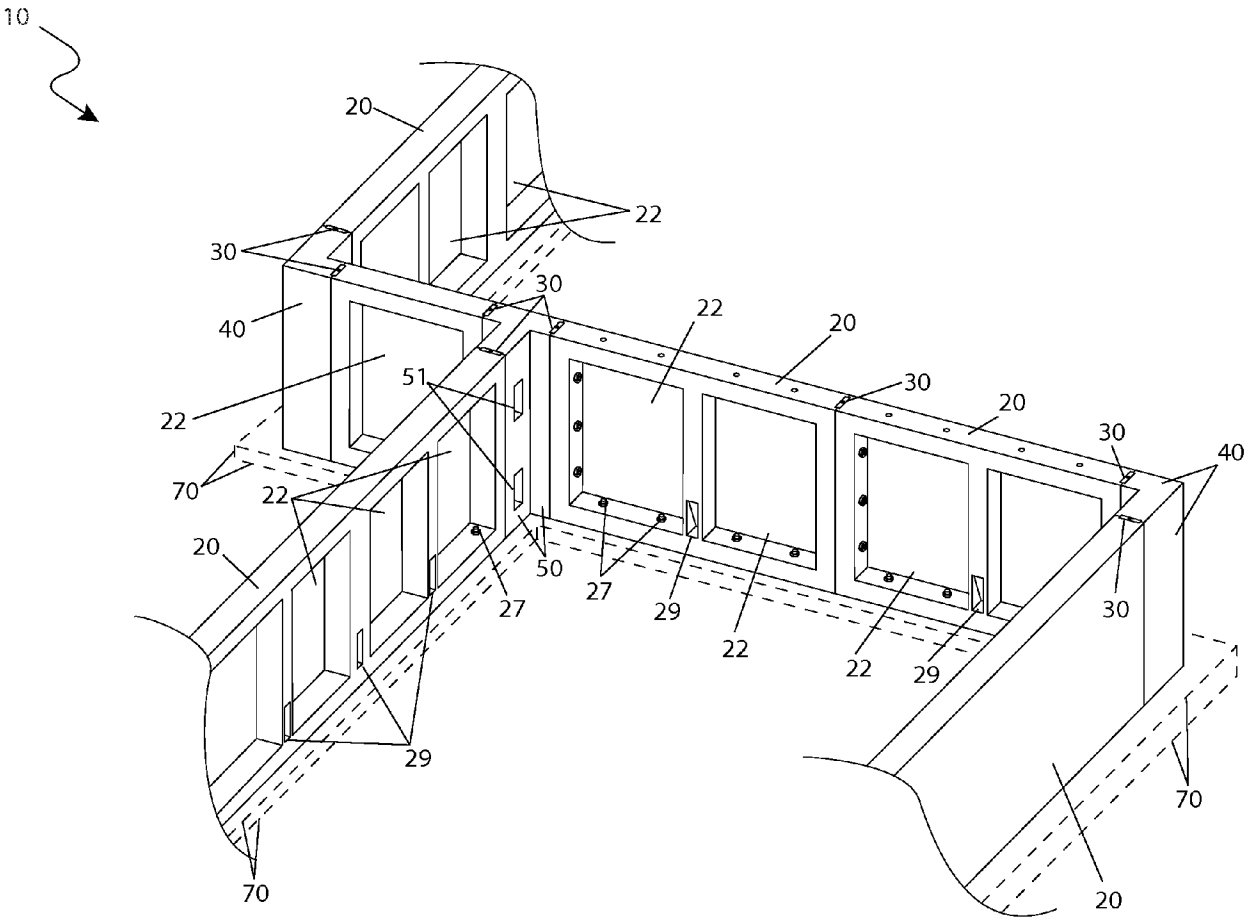
FIG. 1 is a partial environmental view of a plurality of pre-cast concrete wall panels depicted in an assembled state, according to a preferred embodiment in accordance with the invention.

FIG. 1 shows a perspective partial environmental view of the system 10 depicted with a plurality of wall panel members 20 in an assembled state being fastened to a sub-structure of a building, such as a footer 70. The wall panel members 20 are preferably fabricated in various heights, such as two (2) to four (4) feet tall, corresponding to standard crawlspace heights. The wall panel members 20 are also preferably fabricated in various lengths of up to approximately twelve (12) feet long in two (2) foot intervals. The wall panels 20 are fastened to an existing footer 70 using a plurality of anchors 29.

The system 10 is illustrated having a plurality of corner members 40 and T-shaped members 50 which provide transitional structural members for use between the wall panel members 20 to create a crawlspace wall structure for residential or commercial applications. The corner members 40 and T-shaped members 50 are preferably cast in a solid form without recessed areas 22 and include fastener access pockets 51 formed therein to connect adjacent wall panels 20. The corner members 40 and T-shaped members 50 are preferably custom build to correspond to the prescribed floor plan of the particular building, such that the horizontal length of the arm portions correspond to the length needed to contact the side edge of the adjacent wall panel member 20. It can be appreciated by one skilled in the art that the corner members 40 and T-shaped members 50 can also be fabricated offsite using traditional concrete molding techniques or by using a variation of the casting table 100 as will be described herein. The corner members 40 and T-shaped members 50 preferably utilize the joining keyways 30 in a similar manner as used between adjacent wall panels 20 (see FIG. 2).

Furthermore, the various additional pre-cast structural members such as, but not limited to: crawlspace access entrances, pilasters, beam pockets, vent holes, and the like, can be fabricated in a similar fashion utilizing a substantially similar concept to complete a foundational wall project and as such should not be interpreted as a limiting factor of the system 10. The system 10 is depicted here illustrating a portion of a typical crawlspace wall arrangement for clarity of illustration; however, it is understood that any arrangement incorporating elements of the system 10 can be created and as such should not be interpreted as a limiting factor of the system 10.

Figure 2:
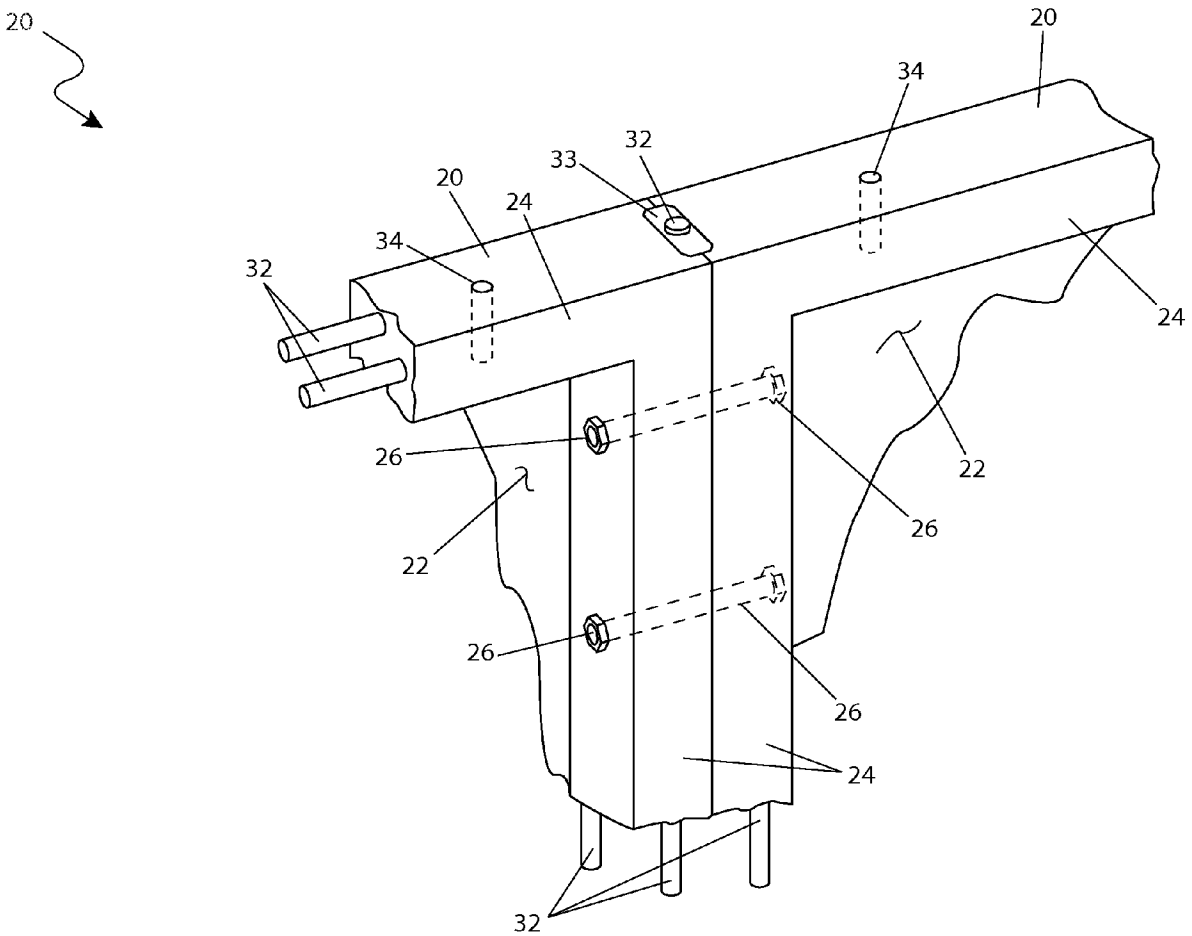
FIG. 2 is a close-up view of an interconnecting joining keyway between adjacent wall panels, according to the preferred embodiment.

FIG. 2 shows a close-up view of a single interconnecting joining keyway 30 between adjacent wall members 20. Interconnection of adjacent wall panels 20, corner members 40, T-shaped members 50, and additional precast members of the system 10, are accomplished by using the interlocking joining keyways 30 formed between the adjacent members 20, 40, 50. A pair of adjacent wall panels 20 is depicted here for clarity of illustration; however, it can be appreciated that the joining keyways 30 can be applied to the corner members 40, the T-shaped members 50, and other structural members of the system 10 in substantially the same manner with equal effectiveness and as such should not be interpreted as a limiting factor of the system 10. Each joining keyway 30 includes a cavity formed by recessed geometric shape which is molded into respective mating faces of adjacent members 20, 40, 50. At least one (1) length of reinforcing bar 32 is inserted within each joining keyway 30 and a volume of non-shrinking grout 33 is placed within the joining keyway 30 around the reinforcing bar 32. Additionally, a plurality of connecting fasteners 26 are inserted through fastener apertures 34 disposed through opposing side edges of each adjacent member 20, 40, 50 to secure them to each other.

Adjacent wall panels 20 are rigidly connected along vertical side ends by use of joining keyways 30. The joining keyways 30 provide for a stable and parallel connection between adjacent wall panels 20. The recessed geometric shapes molded into opposing respective adjacent wall panels 20 are abutted against each other to form a vertical void having a cross-sectional shape of a polygon extending an entire vertical height of the wall panels 20. The wall panels 20 are mechanically joined together using a plurality of horizontal connecting fasteners 26 inserted through an outer wall frame 24 of each wall panel 20 and secured using fastening hardware. The reinforcing bar 32 is be inserted vertically downward into the void for strengthening as desired. The void forming the joining keyway 30 is filled with a volume of non-shrinking grout 33 and cured.

Figure 3:
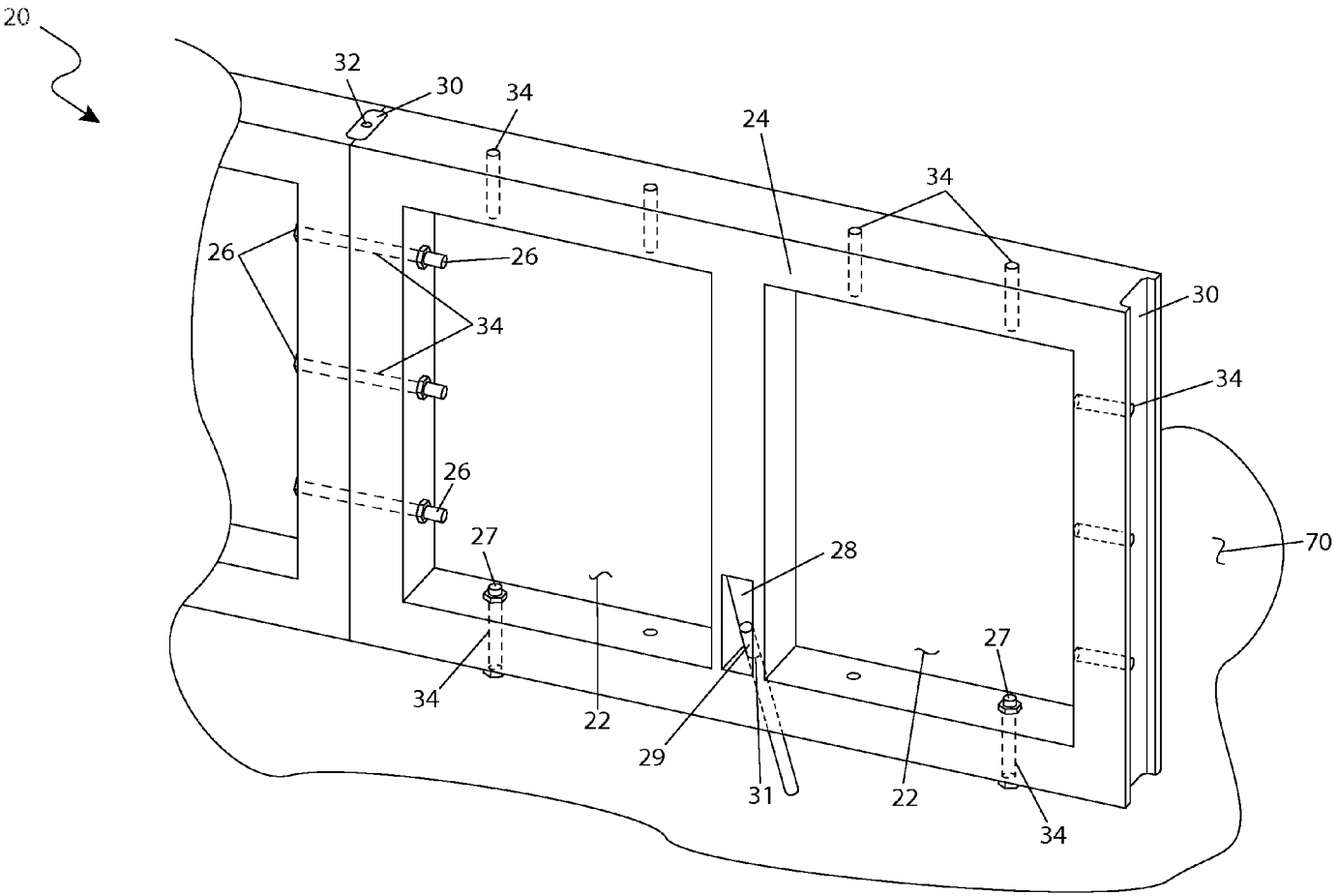
FIG. 3 is a perspective partial environmental view of a wall panel member.

FIG. 3 shows a single wall panel member 20 depicted as attached to an adjacent wall panel member 20 and the footer 70. The wall panel member 20 is positioned atop the footer 70 at the prescribed location for use as a load bearing or non-load bearing structural support. Each wall panel member 20 also includes at least a pair of fastener apertures 34 disposed through the bottom of the wall frame 24. These bottom end fastener apertures 34 receive adjustable leveling bolts 27 which are preferably located at opposing lower outer ends of the wall panel members 20. The leveling bolts 27 provide for independent leveling of each side of the wall panel member 20 and correct for any unevenness of the footer 70.

The anchors 29 are preferably made using sections of reinforcing bars 32 inserted and grouted into anchoring recesses 28 preferably located at a lower central position of each wall panel members 20. The anchoring recess 28 includes an anchoring aperture 31 through the bottom side of the wall frame 24. The anchoring recess 28 and anchoring aperture 31 are preferably at a shallow angle to receive a drill to drive a second anchoring aperture into the footer 70. Once the second anchoring aperture is formed, the reinforcing bar is positioned within the anchoring recess and inserted through the anchoring apertures 31 and into the footer anchoring aperture directly beneath the wall panel member 20. The grout is applied to the reinforcing bar 32 and filled the anchoring recess 28.

It can be appreciated that the wall panels 20 can include any number and arrangement of internal reinforcing rods 32 molded within the wall frame 24 of each wall panel 20 as well as within the transitional and structural members 40, 50 in a conventional manner to improve structural strength based upon particular structural requirements of a concrete wall project. The reinforcing rods 32 are positioned atop the recess mold flanges 172 and can utilize standard rebar spacers and gap fixing mechanisms such as spacer wheels.

The wall panel members 20 are depicted here having a plurality of equally-spaced fastener apertures 34 molded through the top of the wall frame 24 which provide for subsequent attachment of sill plates or other elements required to attach a superstructure to the system 10 using fasteners, such as bolts.

Figure 4:
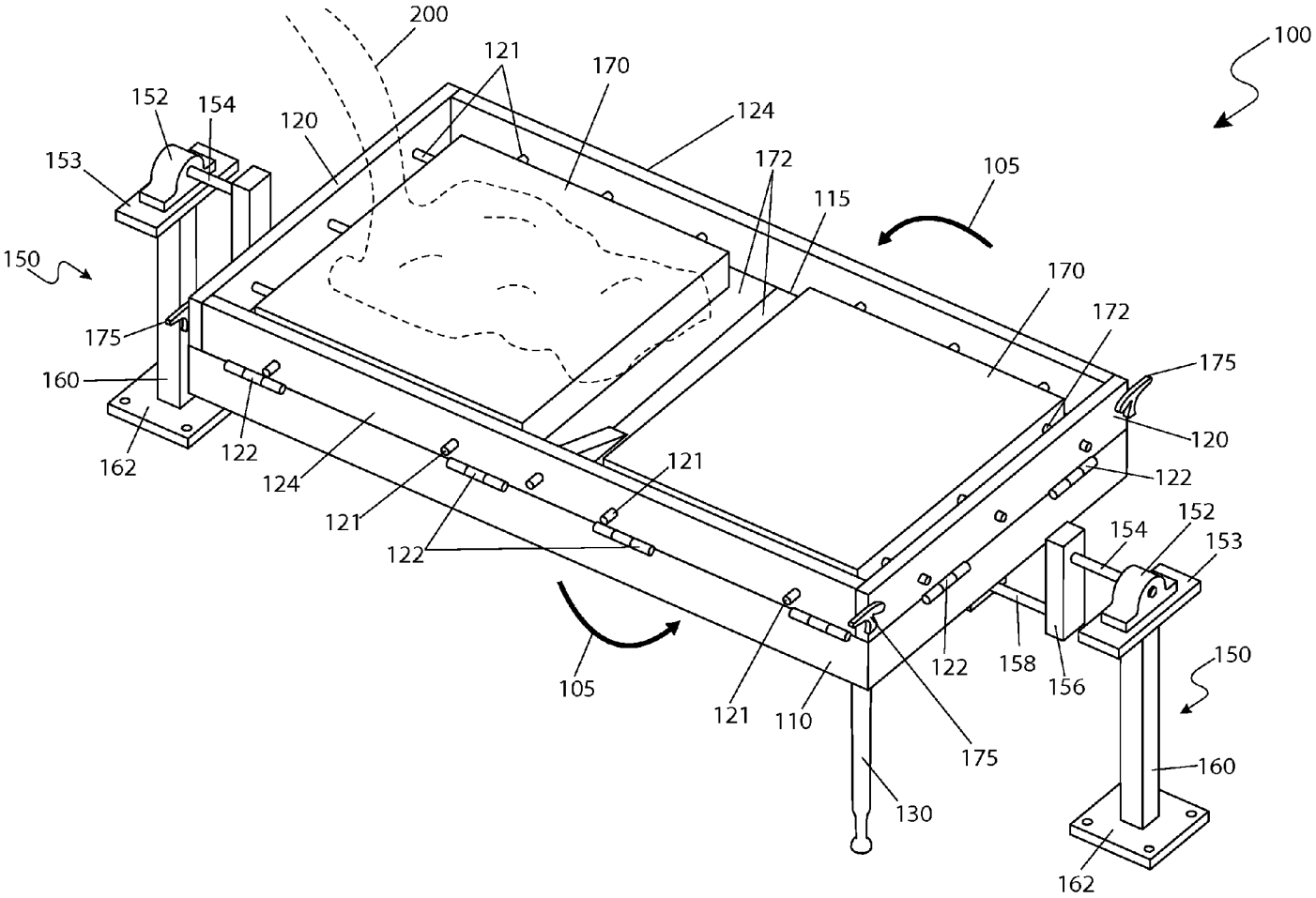
FIG. 4 is a perspective view of a casting table, according to the preferred embodiment.

FIGS. 4 and 5 show a perspective and close-up view of the casting table 100. The casting table 100 provides an efficient and flexible method of fabricating the previously wall panel members 20. The casting table 100 includes a generally waist-high molding frame to hold and cure the concrete wall panel members 20. The casting table 100 reduces the effort, strength, and manpower required by an operator as compared to traditional floor-level casting processes. The casting table 100 allows for a rotating motion 105 of the wall panel members 20 from a generally horizontal orientation during pouring and curing to a generally vertical orientation during the unloading process from the casting table 100 for subsequent transporting to a construction site.

The casting table 100 includes a rectangular horizontal base frame 110 preferably made using lengths of steel channel welded together at corner locations. A main plate 115 is affixed to an entire top surface of the base frame 110 by welding, fasteners, or the like. A pair of first mold panels 120 is hingedly attached to opposing end edges of the base frame 110 and a pair of second mold panels 124 is hingedly attached to front and back edges of the base frame 110. The first mold panels 120 and second mold panels 124 are fastened to the base frame 110 by a plurality of axial hinges 122 which allow the mold panels 120, 124 to upwardly pivot to a vertical position forming a rectangular mold being superjacent and slightly recessed from a perimeter of the base frame 110.

Adjacent ends of each mold panel 120, 124 are fastened to each other at intersecting common corners by a pivoting clamping fixture 175. The clamping fixture 175 is preferably a standard form clamp rotating-key mechanism similar to that offered by EFCO Corporation; however, it can be appreciated that various other concrete form clamping mechanisms can be used with equal benefit to secure the mold panels 120, 124 in the upwardly pivoted position.

The mold panels 120, 124 pivot outwardly to release the cured concrete wall panel member 20. At least one (1) recess mold 170 is affixed to a top of the main plate 115. The recess molds 170 are hollow forms preferably made using plastic, steel, fiberglass, or the like. The recess molds 170 include integral recess mold flanges 172 located around a perimeter edge. The recess mold flanges 172 are fastened to the top surface of the main plate 115. The recess molds 170 have a generally rectangular form having curved edges which create the recessed area 22 in each wall panel member 20 and the recess mold flanges 172 create the wall frame 24. The resultant recessed area 22 is provided along only an inner face of the wall panel member 20. This recessed area 22 provides for reduced volume of concrete 200 needed to produce the wall panel members 20. The casting table 100 is capable of being reconfigured to produce different length wall panels 20, thereby providing increased flexibility during arrangement of a wall project. The wall panels 20 are preferably provided in lengths of two (2) foot increments having a corresponding number of recessed areas 22 within based upon a prescribed length of the wall panel 20 being molded.

The rotating motion 105 of the casting table 100 is accomplished by a pair of rotating assemblies 150, each being connected at opposing ends of the casting table 100. Each rotating assembly 150 comprises a bearing 152, a pedestal 153, a main shaft 154, an offset block 156, an offset shaft 158, a support stand 160, and a stand base 162. The bearing 152 is preferably a heavy-duty pillow block unit positioned above a floor surface at approximately waist height supported by the pedestal 153 and the support stand 160. Each rotating assembly 150 is attached to respective ends of the base frame 110 of the casting table 100 by the offset shaft 158. Each offset shaft 158 is attached to the offset block 156 which is attached to the main shaft 154. The main shaft 154 is rotatingly attached to the bearing 152 along a central axis of the casting table 100. The rotating assemblies 150 position the axis of rotation slightly to a forward end of the casting table 100 such that it is slightly biased toward a forward rotation. This allows the operating user to easily perform the rotating motion 105 of the casting table 100 and the included cured wall panel member 20 to the generally vertical orientation for unloading and subsequent transportation.

FIG. 6 shows a partial top perspective view of the casting table 100 depicted with a single first mold panel 120 and a single second mold panel 124 in the upwardly pivoted position. The opposing mold panels 120, 124 are depicted in the outwardly pivoted position. The top side of the casting table 100 having the recess molds 170, recess mold flanges 172, and the mold panels 120, 124 define the hollow mold into which the concrete 200 is poured. The wall panel members 20 are formed having all the structure features described above in a pre-cast manner. Each of the first mold panels 120 include a beveled keyway mold 123 affixed to an inwardly facing surface and protruding outwardly. The keyway molds 123 create the joining keyways in the opposing outer sidewalls of the wall panel members 20.

Each of the mold panels 120, 124 also include a plurality of rod apertures 125 longitudinally disposed along a generally center line. The rod apertures 125 receive a plurality of aperture rods 121 which are inserted through the mold panels 120, 124 and contact vertical sidewalls of the recess molds 170. The aperture rods 121 form the fastener apertures 34 disposed along the top, bottom, and sides of the wall frame 24.

An anchoring recess mold 127 is affixed to the recess mold flange 172 between two adjacent recess molds 170 and adjacent to the second mold panel 124. The anchoring recess mold 127 creates the anchoring recess 28. The anchoring recess mold 127 is aligned with a rod aperture 125 such that an aperture rod 121 is inserted through the second mold panel 124 and contacts the vertical base side of the anchoring recess mold 127. This configuration creates the anchoring aperture 31 though the bottom side of the wall frame 24.

The aperture rods 121 are inserted through the mold panels 120, 124 after each has been upwardly pivoted into the close position to retain the poured concrete. Once the wall panel members 20 are dried and cured the aperture rods 121 are withdrawn from the rod apertures 125 and thus removed from the wall panel members 20 leaving the fastener apertures 34, anchoring recess 28, and anchoring aperture 31. The edges of all of the forming mold components, including the recess molds 170, anchoring recess mold 127, and keyway mold 123 include beveled edges to facilitate easy disengagement and removal from the concrete wall panel members 20 as they are removed from the casting table 100. The aperture rods 121 are preferably made of PVC tubes or similar materials to which concrete 200 does not bond.

Figure 8A:
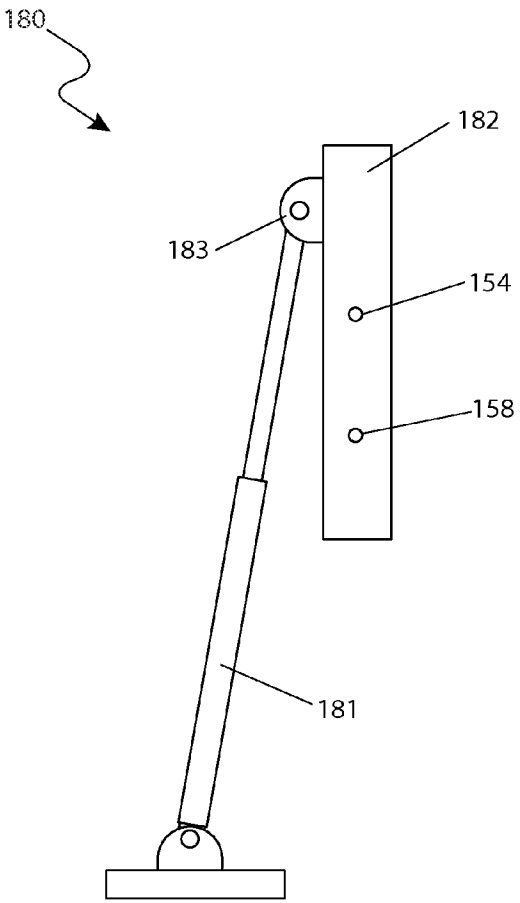

FIG. 7 shows a side view of the casting table 100 having an elongated offset block 182 for mechanical rotation. In an embodiment of the system 10, the casting table 100 includes a mechanical rotating assembly 180. A mechanical actuator 180 is pivotably attached to an upper end of an elongated offset block 182. FIGS. 8*a* and 8*b* show partial side views of the mechanical rotating assembly 180. The casting table 100 can include an attached actuator 181 at either end of the rotating assembly 150 or on both ends. The upper end of the elongated offset block 182 preferably includes a clevis 183 for attachment of the driving end of the actuator 182. A base of the drive cylinder of the actuator 180 is pivotably mounted to a base plate below the elongated offset block 182. The actuator 180 drives the end of the elongated offset block upwardly and downwardly to rotate the casting table 100 between the generally horizontal position as shown in FIG. 8*a* and the generally vertical position as shown in FIG. 8*b*.

The position of the rotating assemblies 150, including the main shaft 154, the offset block 156, and the offset shaft 158 offset the axis of rotation from the center of gravity of the casting table 100. This offset biases the casting table 100 in a top-up orientation when in an empty condition or a full condition after concrete 100 has been poured and is curing.

The casting table 100 also includes a vertical support leg 130 connected to a bottom corner surface of the base frame 110 and extending downwardly to the floor surface. The support leg 130 stabilizes the casting table 100 during pouring and leveling of the concrete 200 keeping it in the generally horizontal orientation. The support leg 130 is preferably an elongated rigid member hingedly attached to the bottom corner surface of the base frame 110 on the forwardly biased end. The support leg 130 can also include length adjustment features, including detent ball mechanisms or vice clamp collars to secure the support leg 130 at the desired length.

It is envisioned that other styles and configurations of the present invention can be easily incorporated into the teachings of the present invention, and only one particular configuration shall be shown and described for purposes of clarity and disclosure and not by way of limitation of scope.

In accordance with the invention, the preferred embodiment can be utilized by the user in a simple and effortless manner with little or no training. After initial purchase or acquisition of the system 10, the wall panel members 20 are fabricated as indicated in FIGS. 1 through 8*a*.

The method of utilizing the casting table 100 to fabricate the wall panel members 20 is achieved by performing the following series of steps. The user selects and configures the casting table 100 having the desired number and orientation of recess molds 170 affixed to the top surface of the base frame 110. This selected orientation produces a wall panel member 20 having the desired length and number of recess areas 22. The casting table 100 is rotated to the generally horizontal position and the base frame 110 is stabilized against the floor surface using the support leg 130. The mold panels 120, 124 are clamped in the upwardly pivoted position using the clamping fixtures 175 to provide the perimeter form of the wall panel members 20. The appropriately desired number of aperture rods 121 is inserted into the prescribed rod apertures 125 through the mold panels 120, 124 to contact the recess mold 170. A volume of concrete 200 is poured into the casting table 100 until the concrete 200 is level with upper edges of the mold panels 120, 124 covering the recess molds 170. The concrete 200 is smoothed and leveled using conventional screening tools and is given sufficient time to cure. Once the wall panel members 20 are cured, the casting table 100 is rotated to the generally vertical position. This rotating motion 105 is accomplished manually or by use of the actuator 180. The aperture rods 121 are removed from the mold panels 120, 124 and thus the wall panel member 20. The mold panels 120, 124 are unfastened and downwardly pivoted to release the wall panel 20 from the casting table 100. The finished wall panel member 20 is removed from the casting table 100 using strapping, carts, cranes, or other rigging devices onto a shipping container or vehicle. This process is repeated until the appropriately required plurality of wall panel members 20 is fabricated for installation to create the structural support. The plurality of wall panel members 20 is transported to the build or construction site. During transportation of the wall panels 20 and other required transitional members 40, 50 to the construction site, the concrete panel members are preferably maintained in a generally vertical orientation to reduce stress thereupon during movement.

The method of installing pre-cast concrete the wall panel members 20 to construct a structural support, such as a crawlspace, is achieved by performing the following series of steps. The wall panels 20 are arranged at the prescribed locations atop the construction footer 70 according the building specification. The transitional members, such as corner members 40, T-shaped members 50, and the like are also position about the poured and cured footer 70 if pre-cast off-site. In an alternate arrangement, the transitional members are formed on-site using traditional concrete forming techniques. In either method, the transitional members are fabricated custom to the prescribed dimensions needed to finish the structure. The transitional members are formed having similar and opposing joining keyways 30 on sidewalls to provide for the attachment of the wall panel members 20. The transitional members are also formed with fastener apertures 34 to receive the connecting fasteners 26 and fastener access pockets 51 which provide access to the connecting fasteners 26. Each wall panel member 20 is leveled by rotatingly adjusting the leveling bolts 27 located on at least opposing lower ends of wall panel members 20. Adjacent wall panel members 20 are fastened and secured together by installing the connecting fasteners 26 through the pre-cast fasteners apertures 34. The vertical reinforcing bars 32 are inserted into the joining keyways 30, using appropriate rebar spacers to position. A second anchor aperture is drilled into the footer 70 directly below the anchoring aperture 31 disposed through the wall frame 24. The anchoring recess provides access to the anchoring aperture 31 for the drill. The anchors 29 are inserted through aligned anchoring apertures to secure the wall panel members 20 to the footer 70. A volume of grout 33 is poured between adjacent wall panel members 20 to fill in the joining keyways 30 and applied to the anchoring recess 28 around the anchor 29. The system 10 is given sufficient time for the grout 33 to bond to the wall panel members 20 and cure.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A casting table for fabricating a pre-cast concrete wall panel member, said casting table comprising:

a generally rectangular base frame rotatably attached between a pair of rotating assemblies;

a flat main plate affixed to a top surface of said base frame;

a pair of opposing first mold panels comprising a hinged attachment to opposing upper side edges of said base frame;

a pair of opposing second mold panels comprising a hinged attachment to opposing upper front and rear edges of said base frame; and, at least one recess mold affixed to a top surface of said main plate;

wherein said hinged attachment enables a pivoting movement of said first mold panels and said second mold panels to an upstanding position;

wherein a clamping fixture fastens adjacent ends of said first mold panels and said second mold panels to secure said upstanding position to define an open top form mold to receive an amount of concrete for casting said wall panel member;

wherein said fabricated wall panel member comprises a perimeter wall frame, a side having a recess area, and an opposing flat side;

wherein said recess area is defined by said at least one recess mold;

wherein said flat main plate is entirely disposed within an inner perimeter of said base frame;

wherein said at least one recess mold is directly engaged with said flat main plate;

wherein said pair of opposing first mold panels is spaced from said pair of rotating assemblies; and, wherein said pair of opposing second mold panels is spaced from said pair of rotating assemblies.

2. The casting table of claim 1, wherein each of said rotating assemblies further comprises:

an offset shaft rigidly affixed to a lower side of said base frame;

an offset block having a lower end rigidly affixed engaged to an end of said offset shaft;

a main shaft rigidly affixed to an upper end of said offset block on an opposite side from said offset shaft; and, a bearing stand supporting a bearing at an elevated position opposite said offset block;

wherein an end of said main shaft opposite said offset block is rotatingly attached to said bearing; and, wherein said base frame is rotatably movable about said main shaft between a generally horizontal position and a generally vertical position.

3. The casting table of claim 2, wherein said recess mold further comprises:

a generally rectangular protrusion having, side walls, a flat surface, and curved edges; and, recess mold flanges extending perpendicularly outward from lower perimeter edge of said sidewalls;

wherein said recess mold flanges are affixed to said main plate;

wherein said protrusion is adapted to form said recessed area; and, wherein said recess mold flanges are adapted to form said perimeter wall frame around said recessed area.

4. The casting table of claim 3, wherein each of said pair of first mold panels further comprises a keyway mold affixed to an inwardly facing surface, said keyway mold is adapted to form a joining keyway longitudinally disposed along opposing side edges of said fabricated wall panel member.

5. The casting table of claim 4, wherein said each of said pair of first mold panels further comprises a plurality of rod apertures longitudinally disposed entirely therethrough; each of said rod apertures insertingly receives one of a plurality of aperture rods inserted into said form mold to contact an adjacent side wall of said recess mold;

wherein each of said aperture rods is adapted to form said fastener aperture completely through said wall frame.

6. The casting table of claim 5, wherein said each of said pair of second mold panels further comprises a plurality of rod apertures longitudinally disposed entirely therethrough; each of said rod apertures insertingly receives one of a plurality of aperture rods inserted into said form mold to contact an adjacent side wall of said recess mold;

wherein each of said aperture rods is adapted to form said fastener aperture completely through said wall frame.

7. The casting table of claim 6, further comprising an anchoring recess mold affixed to said recess mold flange between two adjacent recess molds and adjacent to said protrusion side wall and one of said pair of second mold panels aligned with one of said plurality of second mold panel rod apertures;

wherein said anchoring recess is adapted to form an anchoring recess in said a bottom end of said wall frame;

wherein said one of said plurality of second mold panel rod apertures insertingly receives one of said plurality of aperture rods inserted into said form mold to contact an adjacent surface of said anchoring recess mold; and, wherein each of said aperture rods is adapted to form said fastener aperture completely through said wall frame.

8. The casting table of claim 2, further comprising:

an elongated offset block oppositely spaced from said offset block such that said elongated offset block is located adjacent to a proximal end of said casting table while said offset block is located adjacent to a distal end of said casting table;

a mechanical actuator for mechanically rotating said base frame between said generally horizontal position and said generally vertical position;

wherein said elongated offset block includes an elongated upper end and a clevis attached thereto;

wherein said clevis is attached to said mechanical actuator.

9. The casting table of claim 7, further comprising a support leg coupled to a lower corner surface of said base frame to support said base frame in said generally horizontal position;

wherein said base frame is biased toward a front end.

10. The casting table of claim 7, wherein a plurality of recess molds is affixed to said main plate to provide said wall panel member having a prescribed length and number of recessed areas.

11. The casting table of claim 8, wherein said recess mold further comprises:

a generally rectangular protrusion having, side walls, a flat surface, and curved edges; and, recess mold flanges extending perpendicularly outward from lower perimeter edge of said sidewalls; wherein said recess mold flanges are affixed to said main plate;

wherein said protrusion is adapted to form said recessed area; and, wherein said recess mold flanges are adapted to form said perimeter wall frame around said recessed area.

12. The casting table of claim 11, wherein each of said pair of first mold panels further comprises a keyway mold affixed to an inwardly facing surface, said keyway mold is adapted to form said joining keyway having a generally semi-polygonal recess in said opposing side edges of said wall panel member;

wherein said keyway mold creates a joining keyway longitudinally disposed along opposing side edges of said fabricated wall panel member.

13. The casting table of claim 12, wherein said each of said pair of first mold panels further comprises a plurality of rod apertures longitudinally disposed entirely therethrough; each of said rod apertures insertingly receives one of a plurality of aperture rods inserted into said form mold to contact an adjacent side wall of said recess mold;

wherein each of said aperture rods is adapted to form said fastener aperture completely through said wall frame.

14. The casting table of claim 13, wherein said each of said pair of second mold panels further comprises a plurality of rod apertures longitudinally disposed entirely therethrough; each of said rod apertures insertingly receives one of a plurality of aperture rods inserted into said form mold to contact an adjacent side wall of said recess mold;

wherein each of said aperture rods is adapted to form said fastener aperture completely through said wall frame.

15. The casting table of claim 14, further comprising an anchoring recess mold affixed to said recess mold flange between two adjacent recess molds and adjacent to said protrusion side wall and one of said pair of second mold panels aligned with one of said plurality of second mold panel rod apertures;

wherein said anchoring recess is adapted to form an anchoring recess said a bottom end of said wall frame;

wherein said one of said plurality of second mold panel rod apertures insertingly receives one of said plurality of aperture rods inserted into said form mold to contact an adjacent surface of said anchoring recess mold; and, wherein each of said aperture rods is adapted to form said fastener aperture completely through said wall frame.

16. The casting table of claim 15, further comprising a support leg coupled to a lower corner surface of said base frame to support said base frame in said generally horizontal position;

wherein said base frame is biased toward a front end.

17. The casting table of claim 15, wherein a plurality of recess molds is affixed to said main plate to provide said wall panel member having a prescribed length and number of recessed areas.

18. The casting table of claim 4, wherein said joining keyway has a generally semi-polygonal recess.

19. The casting table of claim 12, wherein said joining keyway has a generally semi-polygonal recess.

* * * * *